US006769755B2

(12) United States Patent
Mizutani et al.

(10) Patent No.: US 6,769,755 B2
(45) Date of Patent: Aug. 3, 2004

(54) INK JET PRINTING METHOD AND INK JET PRINTING APPARATUS

(75) Inventors: Michinari Mizutani, Kanagawa (JP); Shuichi Murakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/391,629

(22) Filed: Mar. 20, 2003

(65) Prior Publication Data

US 2003/0179255 A1 Sep. 25, 2003

(30) Foreign Application Priority Data

Mar. 22, 2002 (JP) ..... 2002-081937

(51) Int. Cl.[7] ..... B41J 29/38; B41J 29/393
(52) U.S. Cl. ..... 347/14; 347/17; 347/19
(58) Field of Search ..... 347/14, 17, 19, 347/20, 9, 11

(56) References Cited

U.S. PATENT DOCUMENTS

| | | | | |
|---|---|---|---|---|
| 5,218,376 A | | 6/1993 | Asai | 347/61 |
| 5,742,301 A | * | 4/1998 | Ikeda | 347/9 |
| 5,774,137 A | * | 6/1998 | Yoshida | 347/14 |
| 6,109,718 A | | 8/2000 | Murakami et al. | 347/14 |
| 6,305,080 B1 | | 10/2001 | Komuro et al. | 29/890.1 |
| 6,350,016 B1 | | 2/2002 | Tachihara et al. | 347/56 |
| 6,428,144 B2 | | 8/2002 | Mizutani | 347/47 |
| 6,439,696 B1 | | 8/2002 | Murakami et al. | 347/56 |
| 6,443,561 B1 | | 9/2002 | Murakami | 347/57 |

FOREIGN PATENT DOCUMENTS

| | | |
|---|---|---|
| JP | 54-161935 | 12/1979 |
| JP | 61-185455 | 8/1986 |
| JP | 61-249768 | 11/1986 |
| JP | 4-10941 | 1/1992 |
| JP | 2543952 | 7/1996 |

OTHER PUBLICATIONS

*Note: U.S. counterpart patent No. 5,218,376 also submitted.

**Note: Abstract for corresponding Japanese Patent Application Laid–Open No. 1–308647 enclosed.

* cited by examiner

*Primary Examiner*—Thinh Nguyen
(74) *Attorney, Agent, or Firm*—Fitzpatrick, Cella, Harper & Scinto

(57) ABSTRACT

An ink jet printing apparatus prevents deterioration of the printed image resulting from degradation of refilling characteristics caused by a rise of the printing head temperature as well as decrease in the printing speed. More particularly, the temperature of the ink ejecting head is measured so that the settings of a pulse width and a drive voltage of a drive pulse to be applied to an electro-thermal converting element are altered based on the measured temperature of the ink ejecting head in such a manner that the pulse width is shortened and the drive voltage is increased as the temperature of the ink ejecting head rises.

18 Claims, 21 Drawing Sheets

| HEAD TEMPERATURE (℃) | ~5 | 5~20 | 20~25 | 25~30 | 30~35 | 35~40 | 40~45 | 45~50 | 50~55 | 55~60 | 60~90 | 90~ |
|---|---|---|---|---|---|---|---|---|---|---|---|---|
| DIGITAL TEMPERATURE INFORMATION | 1 | 2 | 3 | 4 | 5 | 6 | 7 | 8 | 9 | 10 | 11 | 12 |

FIG.7

| PULSE WIDTH (μs) | Vth (V) | k VALUE | Vop (V) | TEMPERATURE (℃) |
|---|---|---|---|---|
| 1.2 | 9.2 | 1.2 | 11 | 25 |
| 0.7 | 11.7 | 1.2 | 14 | 45 |

FIG.19A

| PULSE WIDTH (μs) | PULSE WIDTH (μs) | PULSE WIDTH (μs) | Vth (V) | k VALUE | Vop (V) | TEMPERATURE (℃) |
|---|---|---|---|---|---|---|
| 0.2 | 1.0 | 1.0 | 9.2 | 1.2 | 11 | 25 |
| 0.1 | 1.0 | 0.6 | 11.7 | 1.2 | 14 | 45 |

FIG.19B

| HEAD TEMPERATURE (℃) | Vop (V) | PULSE WIDTH (μs) |
|---|---|---|
| Thead<25 | 11 | 1.2 |
| 25≦Thead<45 | 12.5 | 0.8 |
| 45≦Thead | 14 | 0.7 |

FIG.19C

INK JET PRINTING METHOD AND INK JET PRINTING APPARATUS

This application claims priority from Japanese Patent Application No. 2002-081937 filed Mar. 22, 2002, which is incorporated hereinto by reference.

BACKGROUND OF THE INVENTION

1. Field of the Invention

The present invention relates to an ink-jet printing apparatus and an ink-jet printing method, more particularly, to control of driving a liquid ejection head having electro-thermal converting elements to generate thermal energy used for ejecting ink.

2. Description of the Related Art

One of the generally known ink jet printing apparatuses is that which causes a printing head, for ejecting the ink, to scan in a main scanning direction and causes the printing head to eject ink from nozzles thereof according to driving signals generated from the image data signal, so as to form an image on a printing medium.

Further, printing heads used in this kind of ink jet printing apparatus are generally those described below in terms of ink ejecting methods.

More specifically, the ink ejecting method includes a method using, as an ejection energy generating element for applying energy to eject ink, an electro-thermal converting element (a heater) for generating a bubble to eject the ink, and a method using, as the ejection energy generating element, the piezoelectric element deforming to eject ink. Both these methods enable the ink to be ejected by inputting an electrical signal to the ejecting energy generating element; the former method has an advantage in that a space required for arranging a heater, as being the ejecting energy generating element, is relatively small, and such advantage also contributes not only to simplifying the construction of and reducing the size of the printing head but also to relatively easy accomplishment of the high resolution of ejection orifices.

On the other hand, this method is apt to cause the heat from the heater to be accumulated in the printing head, resulting in a change in the volume of the ink drops to be ejected. Further, cavitation resulting from the break of the bubble sometimes has a serious effect on the performance of the heater.

As the known methods for resolving such problems there are those ink-jet printing methods and the ink-jet printing heads described in, for example, Japanese Patent Application Laying-open No.54-161935 (1979), Japanese Patent Application Laying-open No.61-185455 (1986), Japanese Patent Application Laying-open No. 61-249768 (1986) and Japanese Patent Application Laying-open No. 4-10941 (1992). Each of the printing heads described in these publications has a structure including an ejection orifice for ejecting the liquid, an ink passage communicating with the ejection orifice and filled with the ink and an electro-thermal converting element provided in the ink passage. The electro-thermal converting element, in general, comprises a thin-film resistor, to which a pulse from an electric current (drive pulse) is applied through an electric wire to generate the heat energy. Then, the heat energy causes the air bubble to be generated in the ink to eject the ink, such that the ink is ejected while keeping the air bubble communicating with outside air. Employing this ink ejection method enables stabilization of the volume of ejected ink drops to be improved, high-speed printing with small ink drops and lengthening of the service life of the heater by eliminating occurrence of cavitation caused by the break of the bubble.

However, in the conventional printing head described above, it sometimes occurs that the temperature of the printing head rises especially when ink ejection is continuously performed with high ejection duty (corresponding to a rate of ejected inks to pixels of a predetermined area; in the case of ejecting one ink to each pixel in the predetermined area, the duty is 100%). Such rise of the temperature causes the size of the air bubble to become larger than normal size, thereby causing the amount of moved ink or the moving distance of ink to increase in the ink passage, so that ink is not effectively refilled to the ink passage. As a result, a frequency response characteristic of the printing head decreases.

Taking account of the decrease of the frequency response characteristic to the drive pulse due to the rise of the temperature of the printing head, it can be considered to set the drive frequency to a uniformly lower level. However, this results in overall decrease of a throughput.

On the other hand, for example, Japanese Patent No. 2543952 discloses a method in which the temperature of the printing head is detected and the drive frequency is controlled depending on the detected temperature. However, in the case of the art disclosed in the Japanese Patent, the drive speed of the printing head is lowered immediately after the temperature of the printing head has exceeded a predetermined level of the temperature, so that the decrease tendency of the overall throughput remains unchanged. In order to prevent the throughput from decreasing, there is available a method wherein when the rise of the temperature occurs, the energy to be input to the heater is reduced to suppress the growth of the bubbles. This method, however, gives rise to a problem that when the ink ejection is performed continuously with high ejection duty while the input of the energy is reduced, the drive pulse voltage decreases to decrease an ejection amount of the ink, thereby causing a blur of the printed image in the worst case.

SUMMARY OF THE INVENTION

The object of the present invention is to provide an ink-jet printing method and an ink-jet printing apparatus which is capable of avoiding degradation of a printed image accompanied by a decrease of a refilling characteristic caused by a rise of the temperature of a printing head and preventing a printing speed from decreasing.

In the first aspect of the present invention, there is provided an ink jet printing method using an ink ejecting head having a plurality of ejection orifices and an electro-thermal converting element for generating thermal energy for ejecting ink from the plurality of ejection orifices to perform printing on a printing medium, the method comprising:

a setting step for obtaining temperature of the ink ejecting head and changing settings of a pulse width and a drive voltage of a drive pulse to be applied to the electro-thermal converting element; and a control step for controlling driving of the electro-thermal converting element with the drive pulse having the pulse width and the drive voltage based on a result set by the setting step, wherein the setting step relatively shortens the pulse width and relatively raises the drive voltage as the temperature of the ink ejecting head relatively rises.

In the second aspect of the present invention, there is provided an ink jet printing apparatus using an ink ejecting head having a plurality of ejection orifices and an electro-thermal converting element for generating thermal energy for ejecting ink from the plurality of ejection orifices to perform printing on a printing medium, the apparatus comprising:

setting means for obtaining temperature of the ink ejecting head and changing settings of a pulse width and a drive voltage of a drive pulse to be applied to the electro-thermal converting element; and control means for controlling driving of the electro-thermal converting element with the drive pulse having the pulse width and the drive voltage based on a result set by the setting means, wherein the setting means relatively shortens the pulse width and relatively raises the drive voltage as the temperature of the ink ejecting head relatively rises.

The above and other objects, effects, features and advantages of the present invention will become more apparent from the following description of embodiments thereof taken in conjunction with the accompanying drawings.

BRIEF DESCRIPTION OF THE DRAWINGS

FIG. 7 is a diagram showing a relationship between a digital temperature output signal and the temperature of the printing head;

FIG. 18A is the diagram showing the drive pulse used for a temperature range below a limit temperature at which range refilling failure occurs by increasing of head temperature, FIG. 18B is the diagram showing the drive pulse used for a temperature range exceeding the limit temperature, and FIG. 18C is a plurality of pulses used for one ejection operation of ink;

FIGS. 19A to 19C are diagrams illustrating data stored in a memory, the data showing a relation between the temperature of the printing head and the pulse width and voltage of the drive pulse.

DETAILED DESCRIPTION OF PREFERRED EMBODIMENTS

Embodiments of the present invention will be described by referring to the accompanying drawings.

In the embodiments described below, an ink jet printer as a printing apparatus using an ink jet printing method is shown as an example.

(First Embodiment)

1. Apparatus Body

Figure 8:
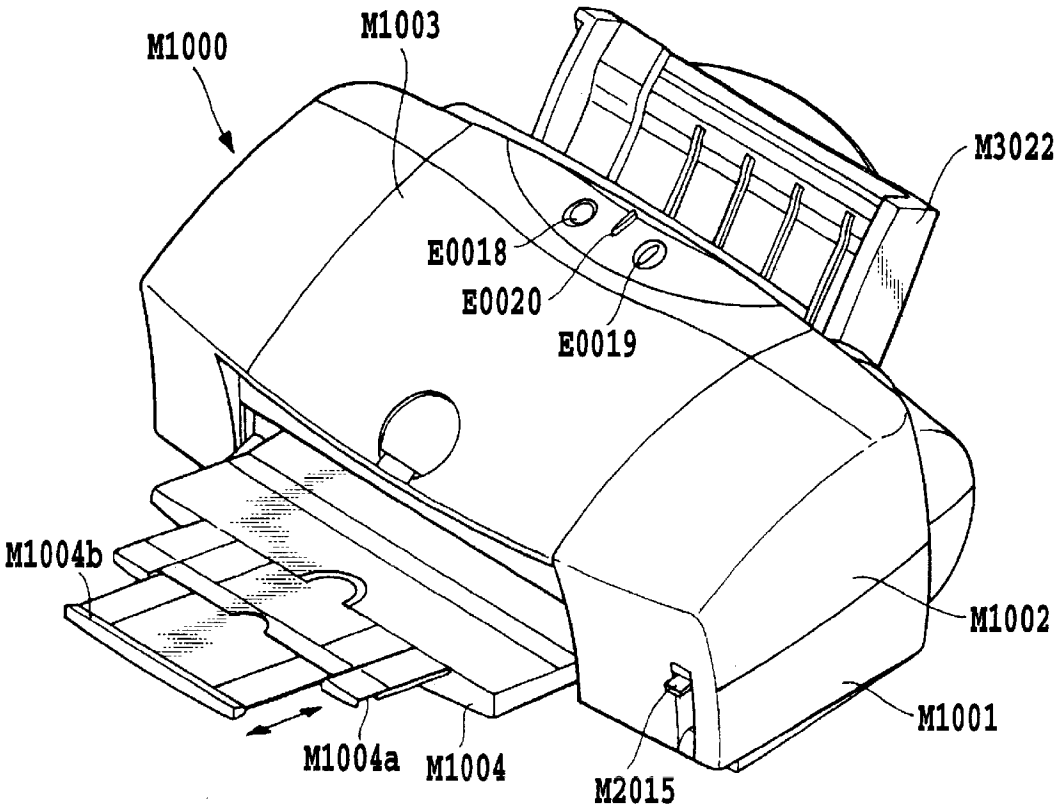
FIG. 8 is a perspective external view of an ink-jet printer according to an embodiment of the present invention.
Figure 9:
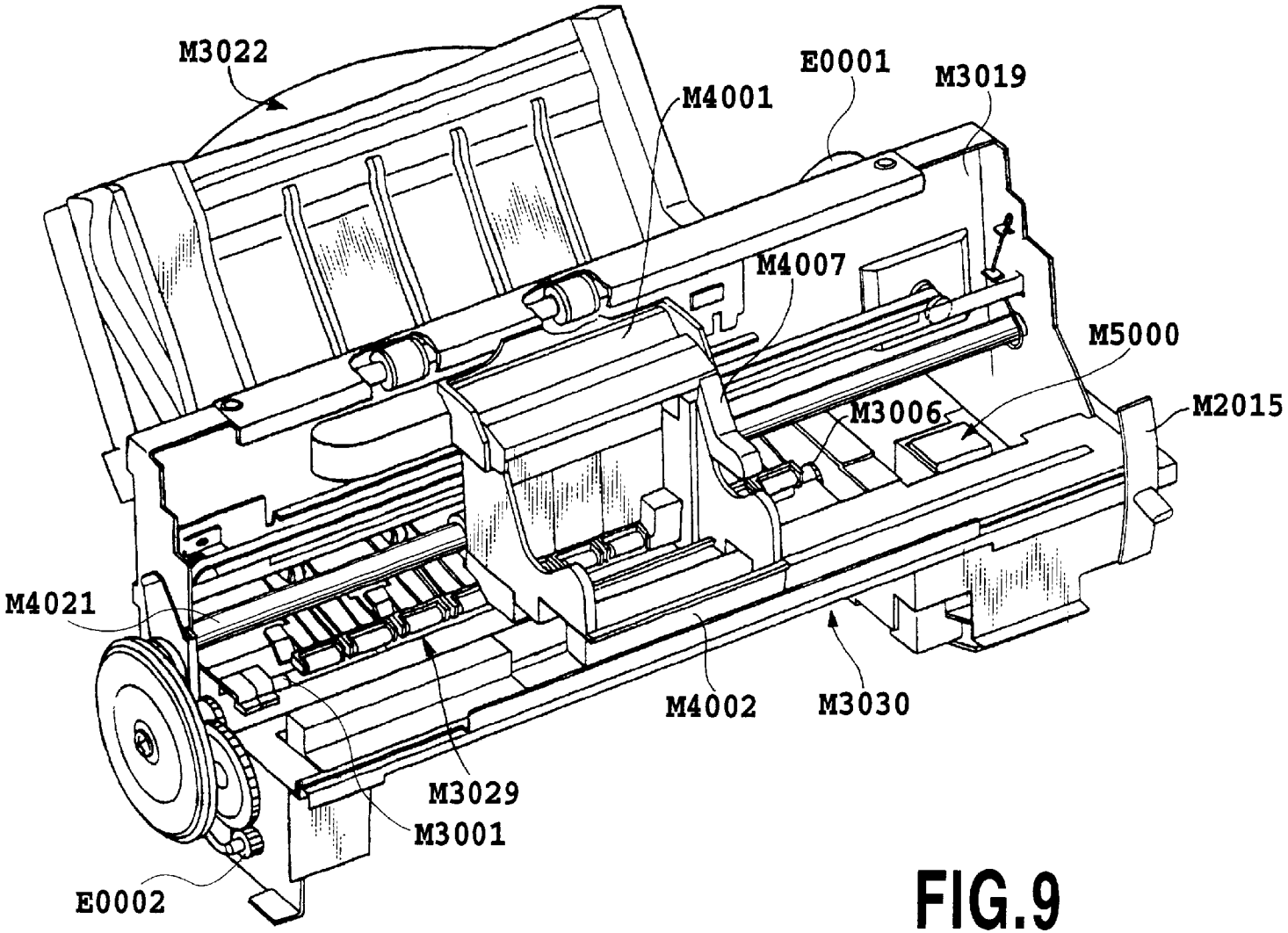
FIG. 9 is a perspective view of the jet-ink printer shown in FIG. 8 with its external members removed.

FIGS. 8 and 9 show an outline construction of a printer using an ink jet printing system. In FIG. 8, a housing of a printer body M1000 of this embodiment has an enclosure member, including a lower case M1001, an upper case M1002, an access cover M1003 and a discharge tray M1004, and a chassis M3019 (see FIG. 9) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has openings in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 (see FIGS. 10 and 11) installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer may be sounded. When the trouble is eliminated, the resume key E0019 is pressed to resume the printing.

2. Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit to perform a desired printing on the print sheet carried to the print position; and an ejection performance recovery unit M5000 to recover the ink ejection performance of the print unit.

Here, the print unit will be described. The print unit comprises a carriage M4001 movably supported on a carriage shaft M4021 and a print head cartridge H1000 (see FIGS. 10 and 11) removably mounted on the carriage M4001.

2.1 Print Head Cartridge

First, the print head cartridge used in the print unit will be described with reference to FIGS. 10 to 12.

Figure 10:
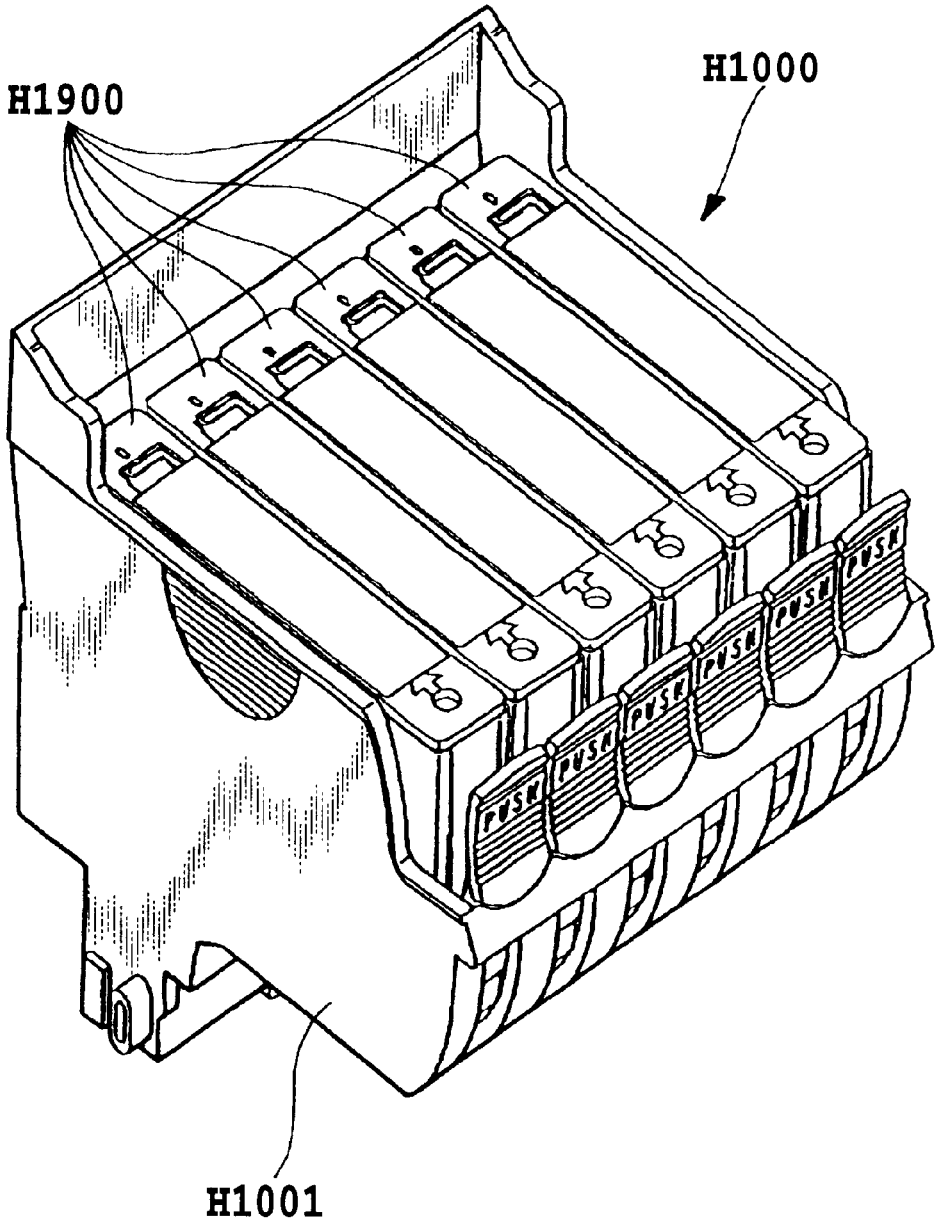
FIG. 10 is a perspective view showing an assembled printing head cartridge used in the embodiment of the present invention.
Figure 11:
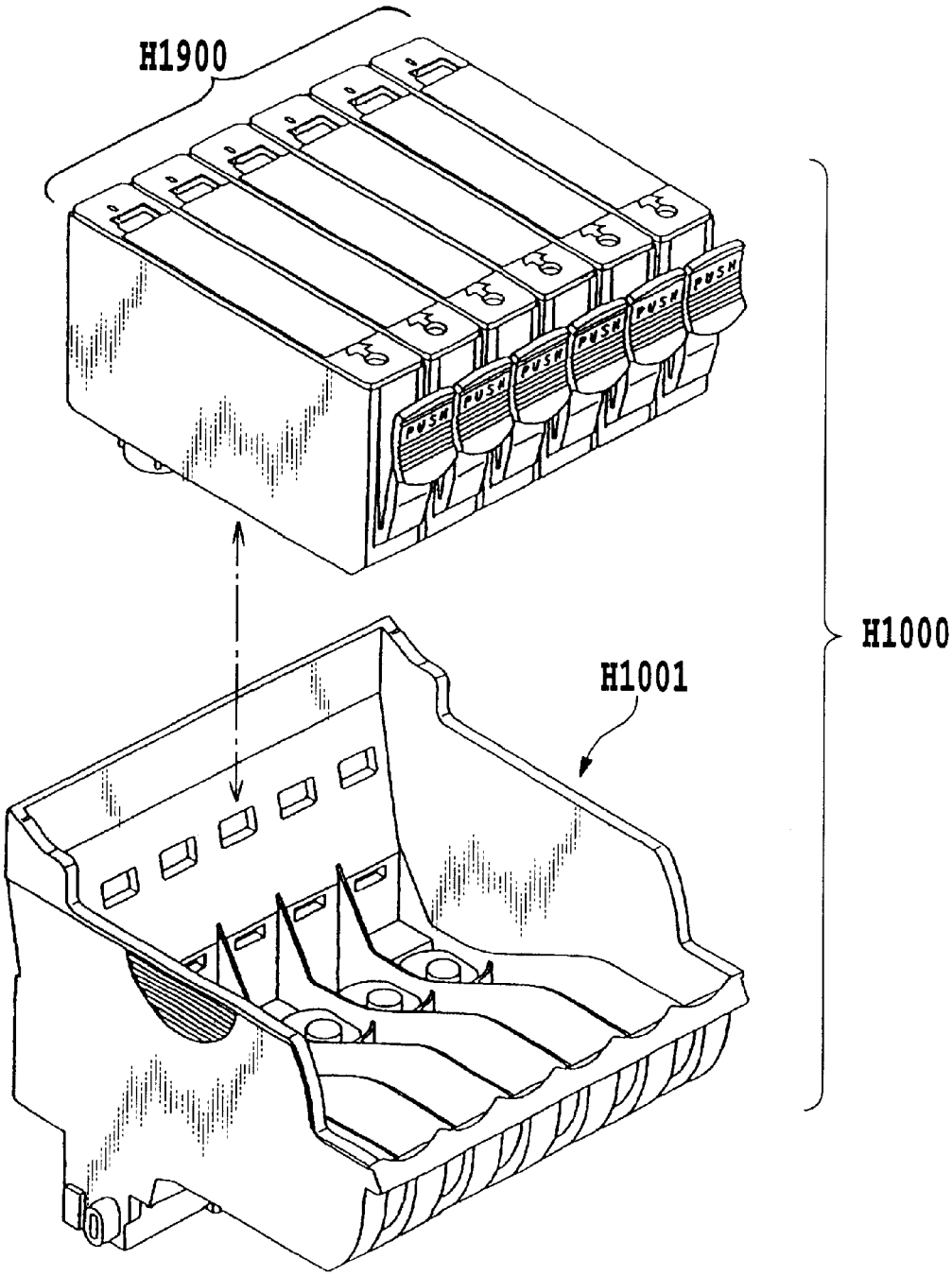
FIG. 11 is a decomposed perspective view of the printing head cartridge shown in FIG. 10.

The print head cartridge H1000 in this embodiment, as shown in FIG. 10, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as a photograph. As shown in FIG. 11, these individual ink tanks are removably mounted to the print head H1001.

Figure 12:
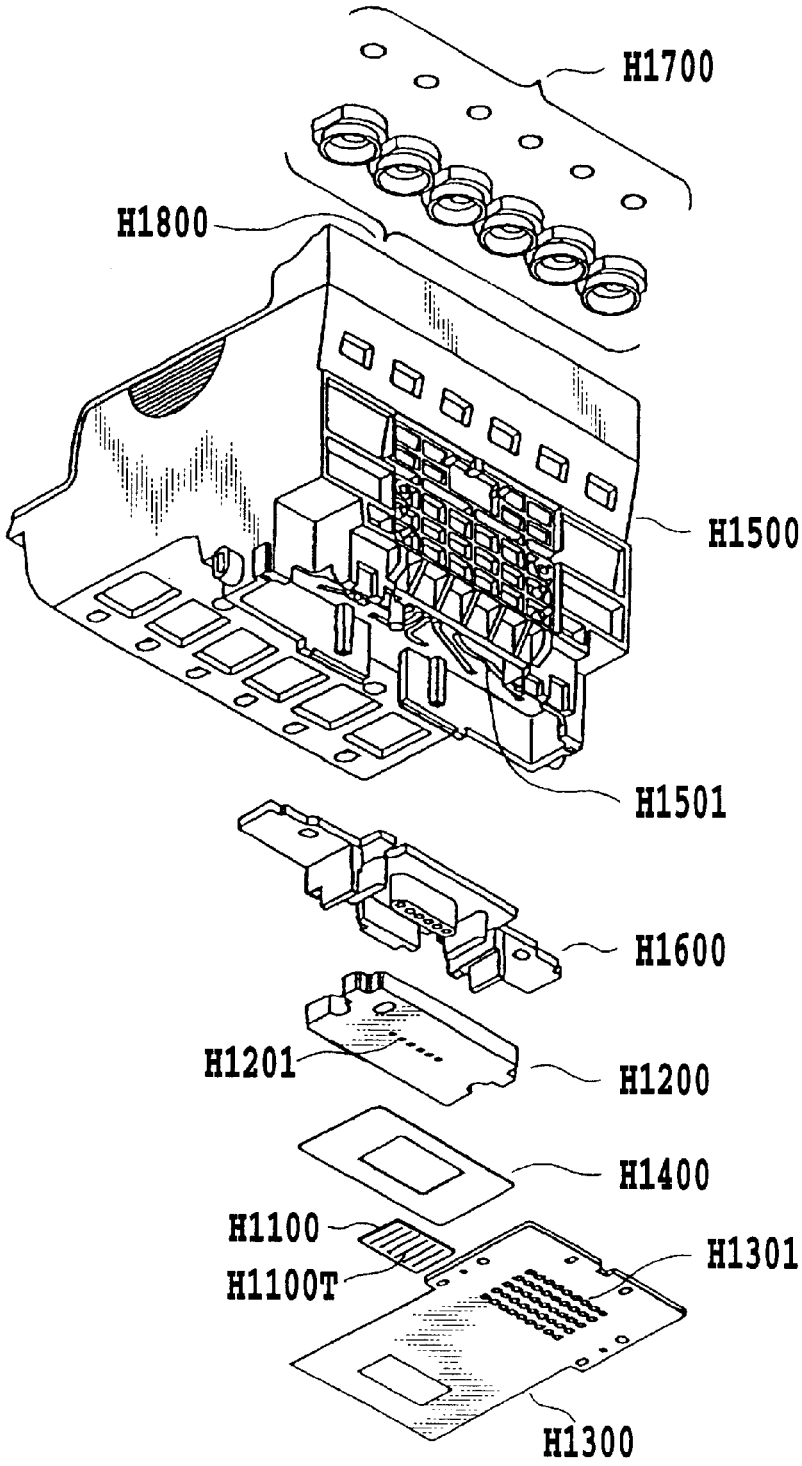
FIG. 12 is a decomposed perspective view of the printing head shown in FIG. 11 as viewed from diagonally underside.

Then, the print head H1001, as shown in the perspective view of FIG. 12, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages.

The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

2.2 Carriage

Next, by referring to FIG. 9, the carriage M4001 carrying the print head cartridge H1000 will be explained.

As shown in FIG. 9, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printer cable (simply referred to as a contact FPC hereinafter) whose contact portion electrically contacts a contact portion (external signal input terminals) H1301 provided in the print head H1001 to transfer various information for printing and supply electricity to the print head H1001.

Between the contract portion of the contact FPC and the carriage M4001 there is an elastic member not shown, such as rubber. The elastic force of the elastic member and the pressing force of the head set lever spring combine to ensure a reliable contact between the contact portion of the contact FPC and the carriage M4001. Further, the contact FPC is connected to a carriage substrate mounted at the back of the carriage M4001.

Next, the detail of a heater substrate (print element substrate H1100) will be described referring to relevant drawings.

Figure 13:
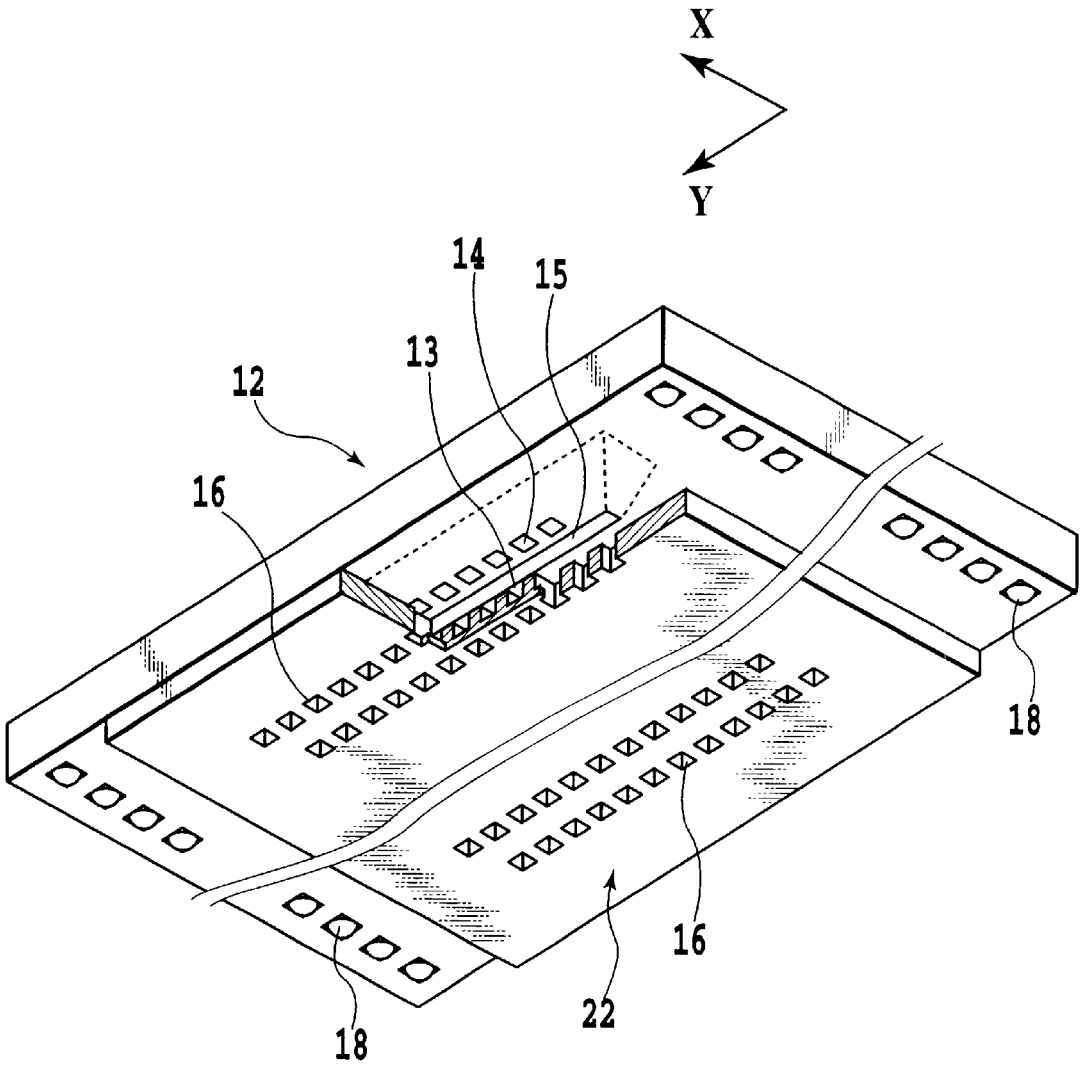
FIG. 13 is a broken view of a heater substrate.
Figure 14:
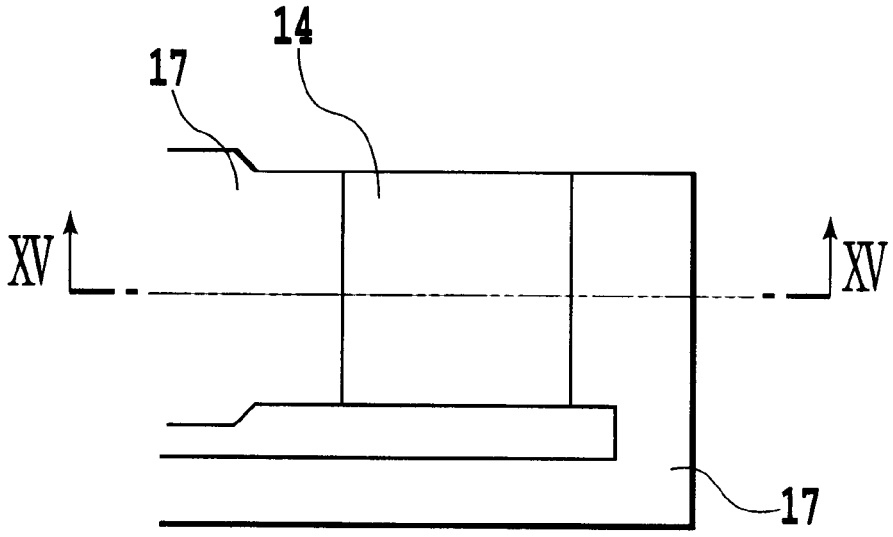
FIG. 14 is a partial enlarged view of the electro-thermal converting element.
Figure 15:
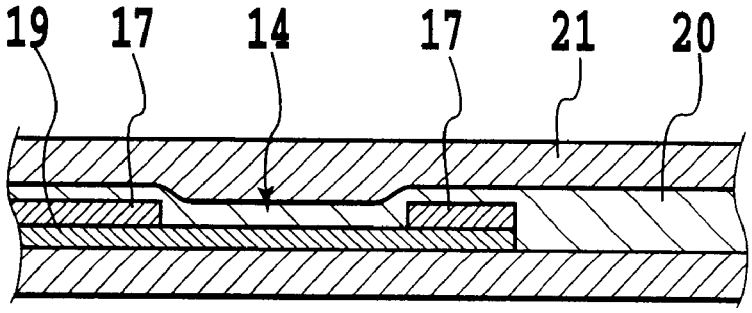
FIG. 15 is a cross-sectional view taken on line XV—XV of FIG. 14.
Figure 16:
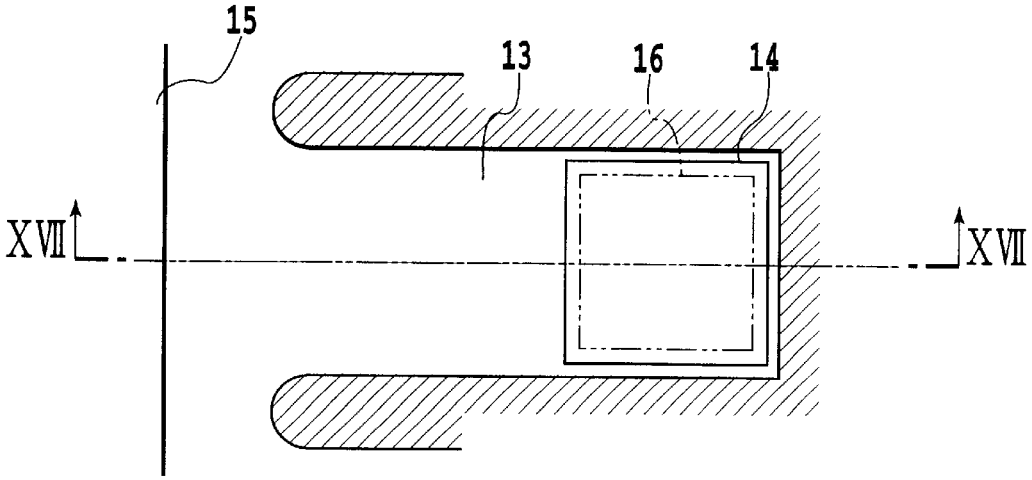
FIG. 16 is a diagram showing the internal structure of an ink passage.
Figure 17:
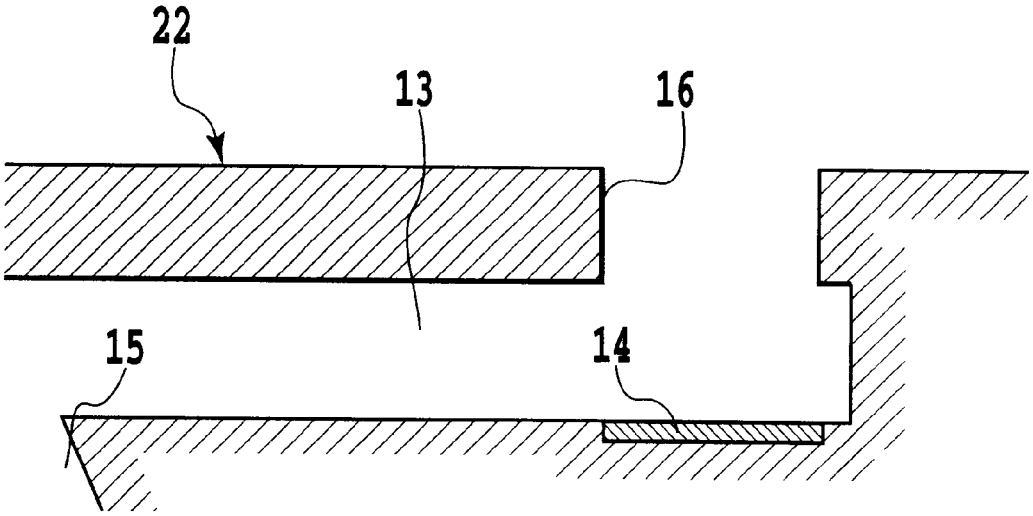
FIG. 17 is a cross-sectional view taken on line XVII—XVII in FIG. 16.

FIG. 13 shows a broken view of the heater substrate 12. A part of the electro-thermal converting element in the substrate is enlarged to be shown in FIG. 14, while its cross section taken along line XV—XV with arrows is shown in FIG. 15. Further, the internal structure of the ink passage is shown in FIG. 16, while its cross-sectional structure along line XVII—XVII with arrows is shown in FIG. 17. More specifically, the heater substrate 12 is, for example, manufactured by using an Si wafer 0.5–1 mm thick, in which six long and narrow ink supply ports arranged in parallel with one another are formed corresponding to the six colors of ink to be used in the ink-jet head.

Each ink supply port 15 is interposed between two parallel rows of ink passages 13 arranged along the ink supply port at predetermined intervals, while each ink passage is provided with an electro-thermal converting element 14 and an ejection orifice 16 for ejecting an ink droplet and arranged oppositely to the electro-thermal converting element 14.

In this embodiment, the two parallel rows of ejection orifices 16 interposing the ink supply port 15 are arranged zigzag by shifting the position of one row by a half pitch of orifices from the other, and the ink passages 13 corresponding to the ejection orifices 16 of each row are arranged at intervals of 600 dpi pitch. Accordingly, the intervals of the ejection orifices 16 arranged along the longitudinal direction of the ink supply port 15, for each of different ink colors, appear as if they were pitched at a high density of 1200 dpi. Further, the electro-thermal converting element 14 and an electrode wiring 17 (see FIGS. 14 and 15), which is formed from Al or the like for supplying power to the electro-thermal converting element 14, are formed on the surface of the Si wafer by means of a film-forming technique, while the other end of the electrode wiring 17 is formed from Au or the like to form a bump 18 projecting from the surface of the heater substrate 12.

In this embodiment, the electro-thermal converting element 14 includes a part of a heating resistor layer 19, (see FIG. 15), which is formed from, for example, TaN, TaSiN, TaAl or the like, is not covered by the electrode wiring 17 which is formed from Al or the like and exhibits the sheet resistance value of 53 Ω. Further, the electro-thermal converting element 14 and the electrode wiring are covered with a protective layer 20 (see FIG. 15) formed from SiN and 3000 Å thick, and on the surface of the protective layer 20 on the electro-thermal converting element 14, a cavitation-proof layer 21 (see FIG. 15) of Ta having a thickness of 2300 Å is formed.

The above stated ink supply port 15 is formed by means of anisotropic etching utilizing the crystallizing orientation of the Si wafer to be used as the heater substrate 12. Further, the ink passage 13 and the ejection orifice 16 are formed by means of a photolithographic process. Then, the printing head having the structure as is described above can be made to eject an ink droplet of about 4 picoliter from the ejection orifice when a voltage pulse is applied to the electro-thermal converting element 14.

Further, in the case of the embodiment described above, the ejection orifice is designed to have a circular cross-section, but the ejection orifice may have polygonal cross-section such as a rectangular or star-shaped section.

Figure 18A:
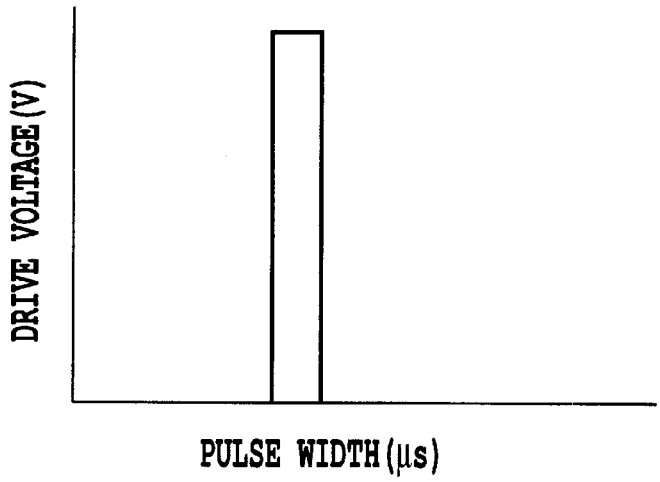
FIGS. 18A–18C are diagrams showing drive pulses applied to a heater in a printing head.

In the present embodiment, a rate at which the drive pulse is supplied to the electro-thermal converting element 14, that is, a drive frequency, is 25 kHz, and the drive pulse is basically a single pulse having a voltage value of 11V and a pulse width of 1.2 μsec as is shown in FIG. 18A. However, the voltage value and the pulse width is subject to alternation depending on the detected temperature of the printing head as described later referring to FIG. 1.

Further, in this embodiment, ink composed of

| | |
|---|---|
| Thiodiglycol | 5.0 weight % |
| Glycerin | 5.0 weight % |
| Urea | 5.0 weight % |
| Isopropyl alcohol | 4.0 weight % |
| Acetynol solution | 1.0 weight % |
| Direct blue 199 | 2.5 weight % |
| Water | Remainder |

is supplied to the ink-jet head.

The present embodiment and a comparative case were evaluated with respect to the ink droplet temperature and the refill frequency (response frequency), and the results of the evaluation are given in Table 1 below.

TABLE 1

| | Present embodiment | | | Comparative case 1 | |
|---|---|---|---|---|---|
| Size of electro-thermal converting element (μm) | 24 × 24 | 24 × 24 | 24 × 24 | 24 × 24 | 24 × 24 |
| Distance to ejection orifice plane (μm) | 25 | 25 | 25 | 25 | 25 |
| Thickness (Å) of cavitation-proof layer | 2300 | 2300 | 2300 | 2300 | 2300 |
| Thickness (Å) of protective layer | 3000 | 3000 | 3000 | 8000 | 8000 |
| Drive voltage (V) | 11 | 11 | 14 | 11 | 14 |
| Drive pulse width (μs) | 1.2 | 1.2 | 0.7 | 1.2 | 0.7 |
| Refilling frequency (kHz) | 30 | 22 | 27 | 15 | 15 |
| Temperature (° C.) | 25 | 45 | 45 | 25 | 45 |

The frequency characteristic of the present embodiment is better than that of the Comparative Case 1 under the same temperature condition, because the thickness of the protective film of Comparative Case 1 is greater than that of the present embodiment, and this causes the printing head of Comparative Case 1 to be less apt to lose the heat thereof. As a result, the formed bubble becomes larger than those in the case of the present embodiment so that the meniscus moves backward much further. Further, in the present embodiment, it can be observed that the frequency characteristic can further be improved with higher voltages and short pulses where the temperature is kept at 45° C., and the energy applied to the electro-thermal converting element is kept constant. The reason for this is that the thicker the protective film, the more easily the heat from the electro-thermal converting element is transmitted to the ink, and the higher the voltage and the shorter the width of the drive pulse, the shorter the time for transmitting heat to the ink from the electro-thermal converting element, so that a thickness of a layer of high temperature ink (high temperature layer) heated for causing the bubble can become small.

Thus, it is desirable for the thickness of the protective layer 20 to be 2000–4000 Å because too large a film thickness causes too great a moving back of the meniscus and the resulting degradation of the frequency characteristic as discussed previously, while too small a film thickness can give rise to problems such as a defective manufacturing process and an adverse effect on durability of the print head.

Further, the film thickness of the cavitation-proof layer of Ta to be formed on the surface of the protective layer 20 is desirably 2000–2600 Å in order to meet the performance requirements.

Thus, it is desirable for the thickness of the covering layer for covering the electro-thermal converting element to be 4000–6600 Å thick.

Figure 6A:
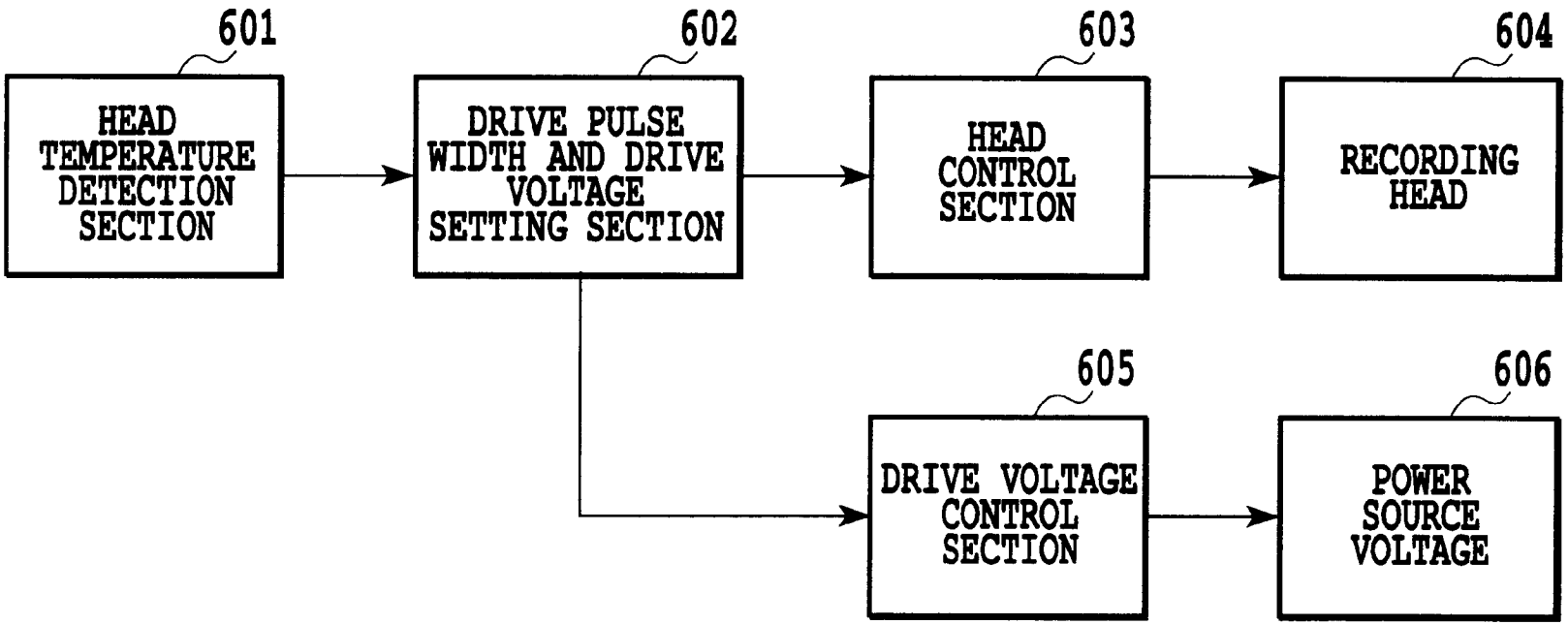
FIG. 6A is a block diagram showing a configuration for changing the width of the drive pulse and the voltage of the drive pulse depending on the temperature of the head.

Next, a configuration for changing the pulse width and the voltage of the drive pulse depending on the detected temperature of the printing head will be described. FIG. 6A is a block diagram showing the configuration for changing the pulse width and the voltage.

In FIG. 6A, the reference numeral 601 represents a head temperature detection section. The printing head according to the present embodiment is internally provided with an analog circuit for detecting the temperature and a circuit for converting an analog signal to a digital signal, thereby enabling the digital signal corresponding to the temperature of the printing head to be outputted. FIG. 7 shows a relationship between the detected temperature of the printing head and the digital temperature output signal. In the above configuration, the temperature of the printing head is obtained by using detected internal temperature. However, the manner of obtaining the temperature is not limited to this configuration. The temperature of the printing head may be obtained by executing a calculation based on a value detected by a temperature sensor provided in the printer body or a value detected regularly by a temperature sensor in the printing head.

In FIG. 6A, a reference numeral 602 represents the drive pulse width and drive voltage setting section. The drive pulse and drive voltage setting stage 602 alters the pulse width and the pulse voltage for the printing operation according to the digital temperature information from the head temperature detection section 601.

Figure 6B:
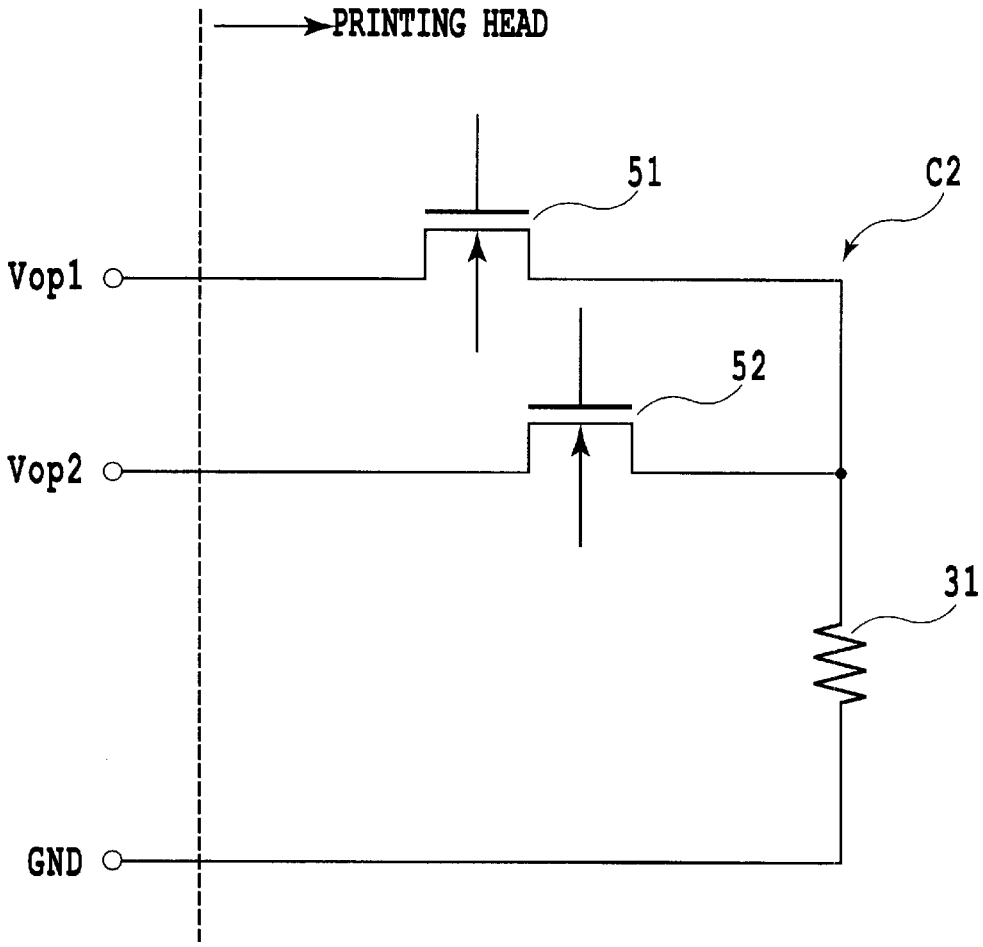
FIG. 6B is a circuit diagram showing one example of a voltage supply circuit for heaters in the printing head according to the present invention.

A setting method of setting the pulse width and the drive voltage according to the present embodiment will be specifically described bellow. The present embodiment has a voltage supply circuit C2 having two systems of voltage supply circuit for supplying two kinds of drive voltage from the printer body to the printing head, as shown in FIG. 6B. Power supply terminals Vop1, Vop2 of the voltage supply circuit C2 are connected to a power supply in the printer body as shown in FIG. 12. Further, the voltage supply circuit C2 has has FETs 51, 52 connected to two the direct current power supply terminals Vop1, Vop2 as switching elements, respectively, and an electro-thermal converting element 31 one end of which is connected to a ground GND of a reference voltage and the other end of which is connected to the FETs 51, 52.

In the voltage supply circuit C2, FET 51 or FET 52 is selectively activated. FET 51 is activated and FET 52 is not activated on the other hand so that a voltage supplied to the terminal Vop1 from the power supply is applied to the electro-thermal converting element 31. On the other hand, FET 51 in not activated and FET 52 is activated so that a voltage supplied to the terminal Vop2 is applied to the electro-thermal converting element 31. As described above, in the present embodiment, two systems of circuit are formed on a substrate of the printing head and respective drive voltages supplied to respective systems of circuit can be changed by selective switching for FET 51 and FET 52. Further, the pulse width can be altered by changing the time during which FET 51 or FET 52 is activated. Then, the refilling frequency of ink can be changed.

In the present embodiment, a drive voltage of 11 V is supplied to one terminal Vop1 and a drive voltage of 14 V is supplied to the other terminal Vop2. When the temperature of the printing head is lower than a threshold temperature Tth, FET 51 is activated and the time during which FET 51 is activated is set so that the drive pulse having the drive voltage of 11 V and a pulse width of 1.2 μsec is applied to the electro-thermal converting element. On the other hand, when the temperature of the printing head is equal to or higher than the threshold temperature Tth, FET 52 is activated and the time during which FET 51 is activated is set so that the drive pulse having the drive voltage of 14 V and a pulse width of 0.7 μsec is applied to the electro-thermal converting element. When setting the drive voltage, a value k is used. In the present embodiment, the value k is 1.2 for both drive voltages.

Descriptions about the value k and how to obtain the value k will be given bellow. A printing head using ink jet method has a threshold value of ejection energy that is a threshold for ink ejection. That is, ink is not ejected until energy applied for ink ejection exceeds the threshold value. The voltage and the pulse width determine the ejection energy, and if the voltage is changed while the pulse width is kept constant, the voltage at which ink is ejected is defined as the threshold voltage Vth. Though the threshold voltage is defined as described above, if the threshold voltage itself is used for driving the printing head, ink ejection becomes not so stable due to a surface characteristic of the electro-thermal converting element. Therefore, a drive voltage greater than the threshold voltage is applied for driving the printing head. In this case, this drive voltage is set to be increased by multiplying a constant value by the threshold voltage, and this constant value is called the value k. That is, an expression (drive voltage Vop)=(value k)×(Vth) is established.

More specifically, a manner of determining the value k is as follows. The threshold voltage Vth is determined by observing whether an ink droplet is ejected or not while varying the applied voltage in a condition of a constant pulse width of the drive pulse supplied to the printing head. Then, (a drive voltage available in the printing apparatus)/(Vth) is calculated to determine the value k. In order to use the constant value k for each drive voltage available in the printing apparatus, the threshold voltages Vth of the printing apparatus are previously obtained and data of their pulse widths and data of the drive voltages are stored in a memory in the printing apparatus. An example of the data is shown in FIG. 19A, in which data of a relation between the drive voltage, the pulse width and the temperature is stored. Then, the drive voltage and the pulse width are determined by referring to the table. Though the threshold value determining whether ink is ejected or not varies depending on the temperature of the ink, the value k is previously set to be constant and therefore printing can be performed while the ejection energy (pulse width×(voltage Vth)$^2$×(value k)$^2$) applied to the printing head is nearly constant.

Figure 3:
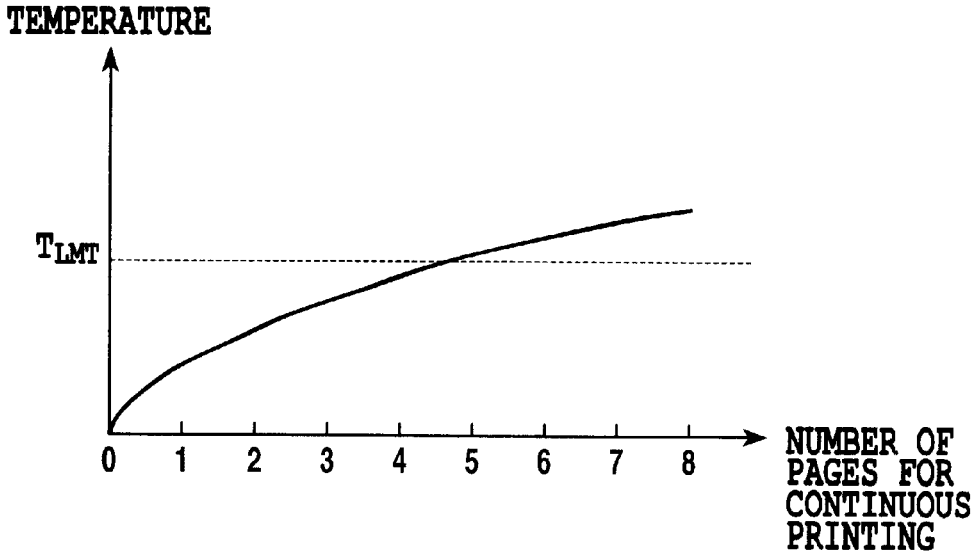
FIG. 3 is a diagram showing a relationship between a number of sheets on which the printing is made and a temperature of the printing head, when a plurality of pages are continuously printed.

As shown in FIG. 3, in the case of a printing head according to the present embodiment, the temperature of the printing head rises depending on the number of pages on which the images corresponding to a predetermined duty are printed continuously. Then, when the temperature of the printing head exceeds limit temperature TLMT shown in FIG. 3, the refilling frequency at the given temperature becomes lower than the drive frequency. As a result, the ink may not be refilled smoothly, thereby causing unstable ejection of the ink and deterioration of the printed image.

Figure 4:
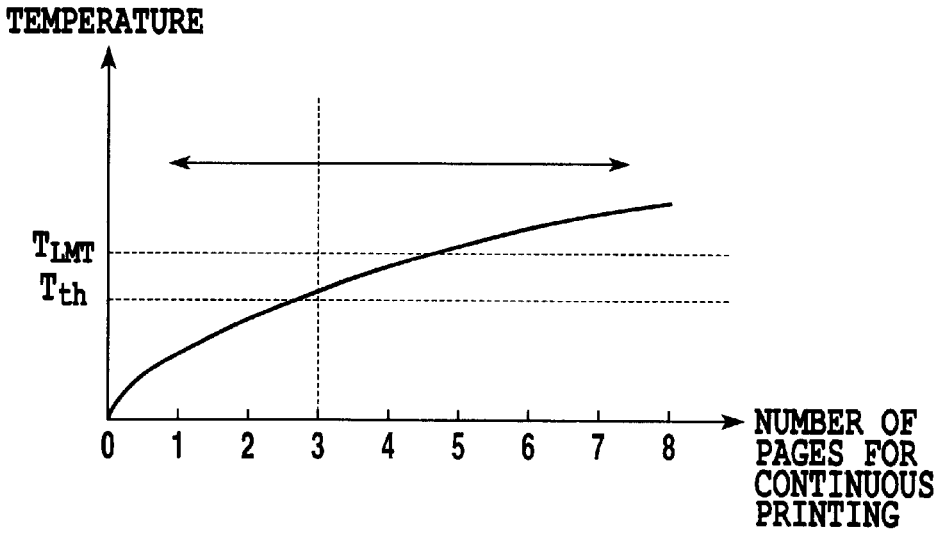
FIG. 4 is a diagram showing a relationship between a number of sheets on which the printing is made and a temperature of the printing head, when a plurality of pages are continuously printed.
Figure 18B:
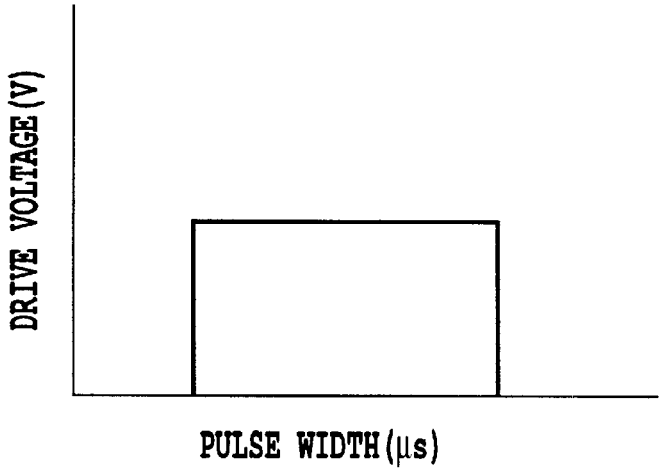

Therefore, as shown in FIG. 4, the threshold temperature Tth, which is lower than the limit temperature TLMT at which the deterioration of the image occurs, is set. Then, when the temperature of the printing heads exceeds this temperature, the pulse width and the drive voltage of the drive pulse is altered so that the basic pulse width Po (μs)=1.2 μsec and the basic drive voltage Vo (V)=11 V are changed into the pulse width Pt ($\mu$s)=0.7 $\mu$sec and the drive voltage Vt (V)=14 V, respectively. FIGS. 18A and 18B show wave forms of the drive pulses. When the temperature Tth is equal to or less than the temperature TLMT, the wave form shown in FIG. 18B is used, and when the temperature Tth is greater than the temperature TLMT, the wave form shown in FIG. 18A is used. In this case, Po>Pt, and Vo<Vt. In this alteration, since the value k is constant, the energy (pulse width×(voltage Vth)$^2$×(value k)$^2$) applied to the printing head can be kept to be nearly constant. Thereby, the refill frequency can be prevented from decreasing at the time when the head temperature rises while preventing an adverse effect such as the decrease in an ejection amount.

Figure 1:
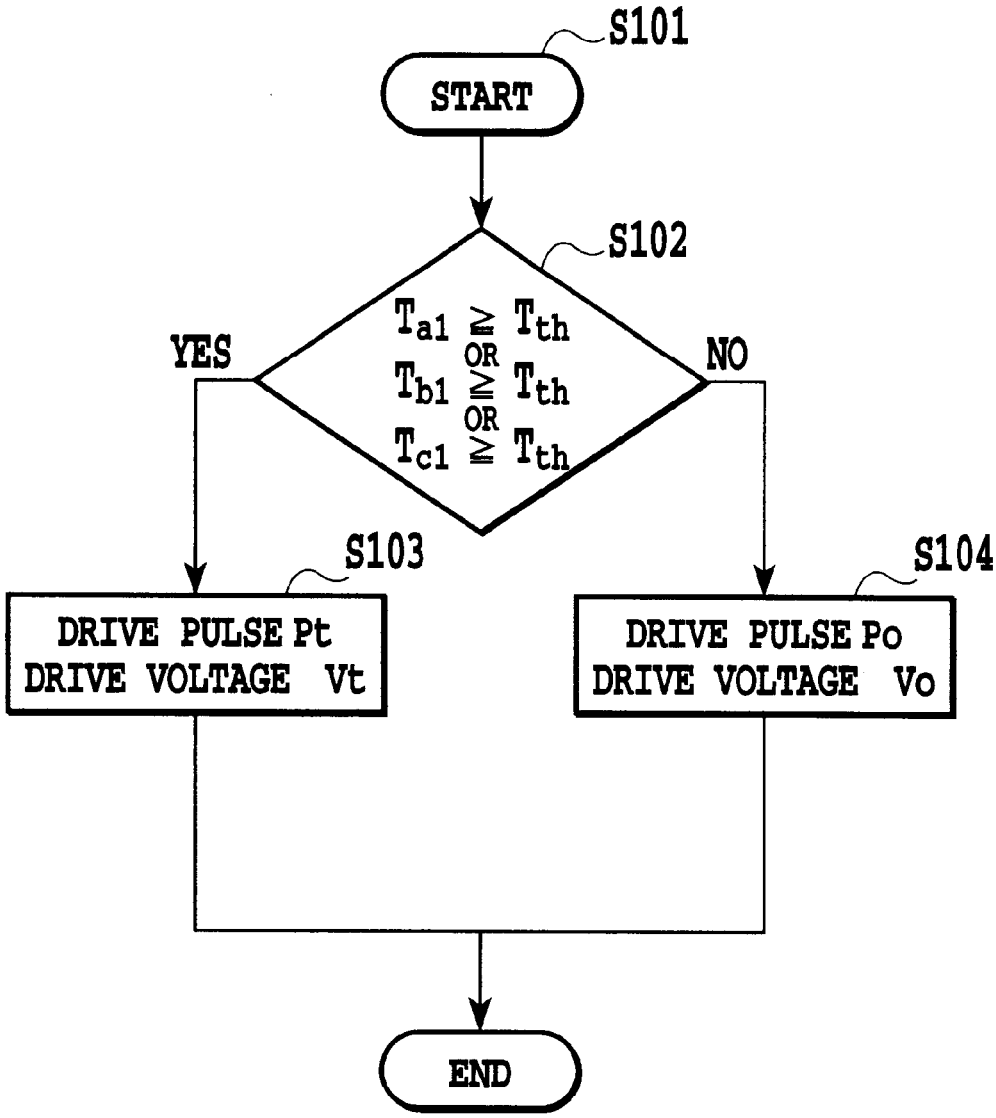
FIG. 1 is a flow chart showing processes for setting a width of a drive pulse and a voltage of the drive pulse, according to first and second embodiments of the present invention.

FIG. 1 is a flow chart showing the sequence of data processing for the drive pulse width and drive voltage setting section 602.

Figure 5:
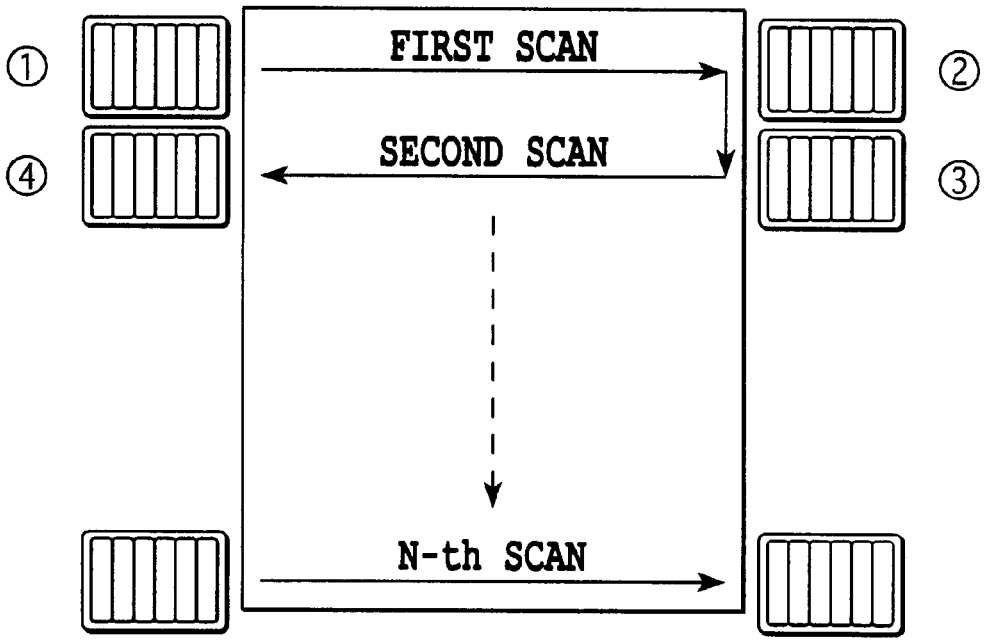
FIG. 5 is a diagram showing the scanning manner of the printing head.

This processing is started at the beginning of printing on each page. More specifically, as shown in FIG. 5, a printing operation is performed in order for the scanning operation starting from the first scan of ① to ②, proceeding to the second scan of ③ to ④, and ultimately to the N-th scan, which is the last scan for a given page. In this operation, the data of the temperature of the printing head is acquired at the point ①, the point immediately preceding the first scan, to start the processing illustrated in FIG. 1. At step S102, the inputted head temperature is compared with the threshold temperature relating to the alteration of the drive pulse.

Figure 2:
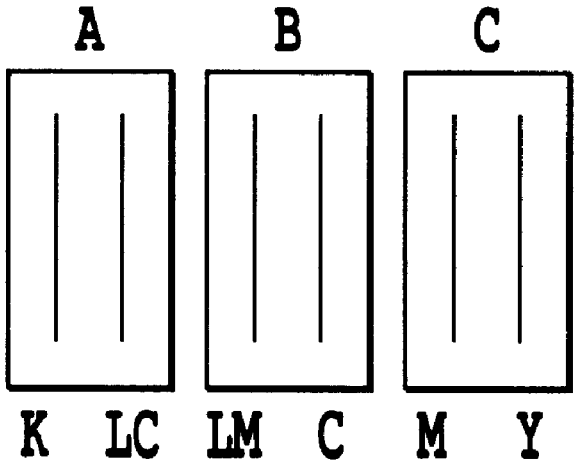
FIG. 2 is a diagram showing a composition of a printing head chip.

In the case of the printing head according to the present embodiment, one chip is provided for the inks of 2 different colors as shown in FIG. 2. That is, chip A for black ink (K) and light cyan ink (low-concentration cyan ink: LC); chip B for light magenta ink (low-concentration magenta ink: LM) and cyan ink (C) and chip C for magenta ink (M) and yellow ink (Y) are provided in combination with one another, and each of the chips is provided with the previously mentioned temperature information output circuit. Where the digital output values of the temperatures of the chips at the time of the n-th scan are given as Tan, Tbn and Tcn respectively, in the case of the present embodiment, in the step S102, the temperatures Ta1, Tb1 and Tc1, which are the temperatures measured immediately preceding the first scan, are compared with the threshold value Tth.

If the temperature of any one of the chips is equal to or greater than the threshold value Tth, the processing proceeds to step S103 to set the pulse width and the drive voltage of the drive pulse to Pt ($\mu$s) and Vt (V) respectively. On the other hand, if the temperatures of all the chips are less than the threshold value Tth, the processing proceeds to step S104 to set the pulse width and the drive voltage of the drive pulse to the basic Po ($\mu$s) and Vo (V).

A head control section 603 shown in FIG. 6A supplies a control signal, for generating the drive pulse, set by the drive pulse width and drive voltage setting section 602 to the driver of the printing head to drive the printing head. Further, a power source voltage control section 605 selects a main power source in a power source voltage section 606 so as to set the power source corresponding to the power source voltage set by the drive pulse width and the drive power source voltage setting stage 602. A mechanical switch or an electronic switch may be used as selecting device for selecting the main power source. Further, a DC—DC converter may be used as the power source. The DC—DC converter generates a voltage for an output based on a standard voltage, to which an output from an external DA converter may be given to vary the standard voltage so that the voltage for the output can be varied at multi-levels.

Here, how to set the threshold temperature Tth relating to the alteration of the pulse width and the drive voltage of the drive pulse in the case of the present embodiment will be discussed referring to FIG. 4.

FIG. 4 shows the head temperature rise characteristic for the number of pages when printing of images on a plurality of pages is carried out continuously at the highest possible printing duty for each page. In this example, the head temperature exceeds the limit temperature TLMT, at which the inadequacy of refill due to the rise of the head temperature occurs, when the printing operation has progressed to the middle of fourth page. Thus, in the case of the present embodiment, the threshold temperature is set to a temperature which is lower than the head temperature at the beginning of the third page so that the drive pulse can be altered at the beginning of the third page, and the threshold temperature Tth is set by the unit of 5° C., which is the resolution of the digital temperature output as is shown in FIG. 7. In the present embodiment, the threshold temperature Tth is set to 45° C.

Further, in the case of the embodiment discussed above, the temperature detection timing is set to the beginning of the page, but it is desirable for the timing to be set to the beginning of each scan within a given page if the timing can be synchronized with the temperature information acquiring timing or the determination data processing timing. With the system described above, unlike the case of the conventional system, it becomes possible to improve the throughput to the greatest possible extent without causing the decrease of the refill frequency throughout the period of the printing operation from the third page on.

(Second Embodiment)

Figure 18C:
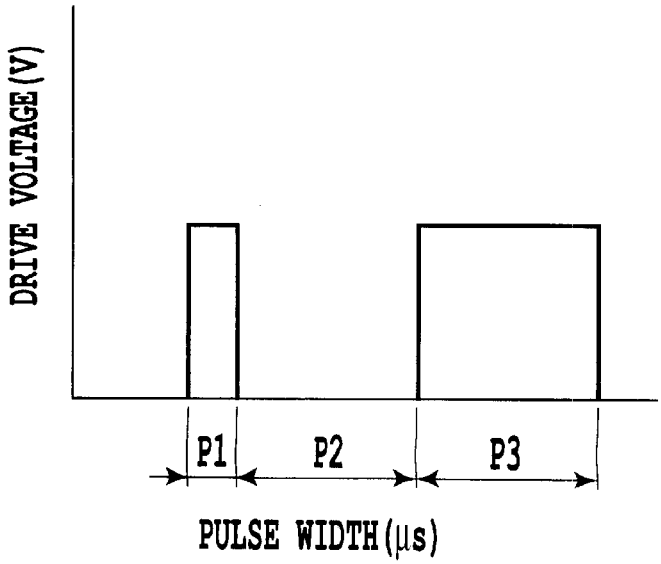

The present embodiment is related to a manner of driving the printing head different from the manner in the above first embodiment, while structures of the apparatus and the printing head are the same as in the first embodiment. The present invention is not limited to the application of a drive pulse consisting of a single pulse. As shown in FIG. 18C, ejecting one ink droplet may be performed by the application of a drive pulse consisting of a plurality of pulses. That is, when the basic drive voltage is 11 V, the plurality of pulses are set to be as shown in FIG. 18C, P1=0.2 $\mu$sec, P2=1.0 $\mu$sec, P3=1.0 $\mu$sec. In FIG. 18C, P1 expresses a pre-pulse that functions as a pulse increasing the temperature of ink near the electro-thermal converting element 31 to a temperature at which the ink is not ejected. P3 expresses a main pulse that functions as a pulse increasing the temperature of the ink to a bubbling temperature for ejecting ink. Further, P2 expresses a pulse pause time. Thus, application of the plurality of pulses (which is a double pulse in the present embodiment) enables the power of the bubble to be increased. Further, controlling the width of the pulse and the pulse pause time enables the amount of heat applied to the ink to be controlled so that the bubble power can be easily controlled.

In the present embodiment the data stored in the memory of the printer is shown in FIG. 19B, in which data of a relation between the drive voltage, the pulse width and the temperature is stored. Though the threshold voltage determining whether ink is ejected or not varies depending on the temperature of the ink, the value k is previously set to be constant and therefore printing can be performed while the ejection energy (pulse width (P1+P3)×(voltage Vth)$^2$×(value k)$^2$) applied to the printing head is nearly constant.

Here, how to set the threshold temperature relating to the alteration of the pulse width and the drive voltage of the drive pulse in the case of the present embodiment will be discussed referring to FIG. 4. FIG. 4 shows the head temperature rise characteristic for the number of pages when the printing of images on a plurality of pages is carried out continuously at the highest possible printing duty for each page. In this example, the head temperature exceeds the limit temperature TLMT, at which the inadequacy of refill due to the rise of the head temperature occurs, when the printing operation has progressed to the middle of fourth page. Thus, in the case of the present embodiment, the threshold temperature is set to a temperature which is lower than the head temperature at the beginning of the third page so that the drive pulse can be altered at the beginning of the third page, and the threshold temperature Tth is set by the unit of 5° C., which is the resolution of the digital temperature output as is shown in FIG. 7. In the present embodiment, the threshold temperature Tth is set to 40° C. The reason for this is that in the case of using the double pulses as in the present embodiment, the energy contributed for bubbling increases and therefore the amount of the meniscus moving backward increases much more than in the case of the first embodiment, which causes the refilling frequency to be decreased.

As shown in FIG. 3, in the case of a printing head according to the present embodiment, the temperature of the printing head rises depending on the number of pages on which the images corresponding to a predetermined duty are printed continuously. Then when the temperature of the printing head exceeds limit temperature TLMT shown in FIG. 3, the refilling frequency at the given temperature becomes lower than the drive frequency. As a result, the ink may not be refilled smoothly, thereby causing unstable ejection of the ink and deterioration of the printed image. Therefore, as shown in FIG. 4, the threshold temperature Tth, which is lower than the limit temperature TLMT at which the deterioration of the image occurs, is set. Then, when the temperature of the printing heads exceeds this temperature, the pulse width and the drive voltage of the drive pulse is altered so that the basic pulse width Po ($\mu$s)=P1+P3=1.2 $\mu$sec and the basic drive voltage Vo (V)=11 V are changed into the pulse width Pt ($\mu$s)=P1+P3=0.7 $\mu$sec and the drive voltage Vt (V)=14 V, respectively. The wave form shown in FIG. 18B is used, both when the temperature Tth is equal to or less than the temperature TLMT, and when the temperature Tth is greater than the temperature TLMT. In this case, Po>Pt, and Vo<Vt. In this alteration, since the value k is constant, the energy (pulse width (P1+P3)×(voltage Vth)$^2$×(value k)$^2$) applied to the printing head can be kept nearly constant. Thereby, the refill frequency can be prevented from decreasing at the time when the head temperature rises while preventing an adverse effect such as the decrease in an ejection amount.

As described above, also in the case of performing one ejection operation by using a plurality of pulses, an effect similar to that of the first embodiment can be obtained.

(Third Embodiment)

A third embodiment of the present invention will be described below. The third embodiment is related to a procedure of the drive pulse width and drive voltage setting section 602 different from the procedure in the first embodiment, while the structures of the apparatus and the printing head are the same as in the first and second embodiments.

Figure 20:
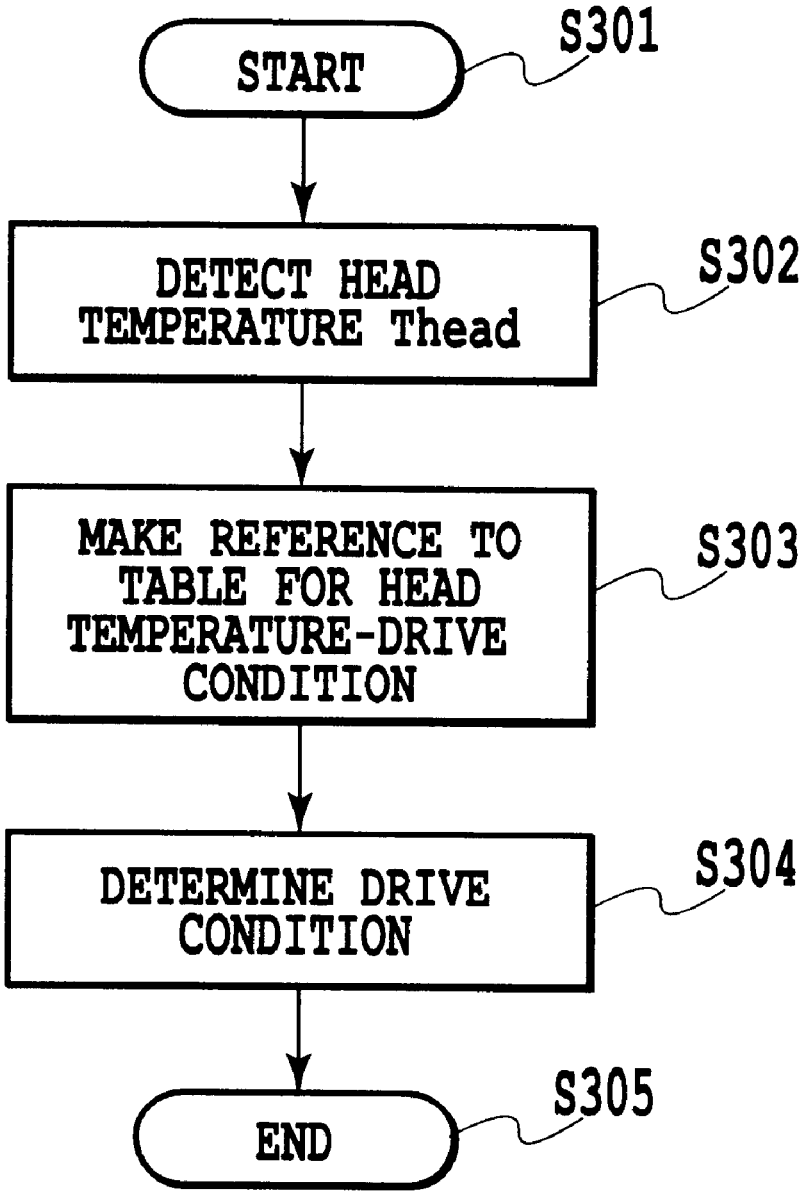
FIG. 20 is a flow chart showing processes for setting a width of a drive pulse and a voltage of the drive pulse, according to a third embodiment of the present invention

FIG. 20 is a flow chart showing the sequence of data processing for the drive pulse width and drive voltage setting section 602.

This processing is started at the beginning of printing on each page. More specifically, as shown in FIG. 5, a printing operation is performed in order for the scanning operation starting from the first scan of ① to ②, proceeding to the second scan of ③ to ④, and ultimately to the N-th scan, which is the last scan for a given page. In this operation, the data of the temperature of the printing head is acquired at the point ①, the point immediately preceding the first scan, to start the processing illustrated in FIG. 20. At step S302, the temperatures Ta1, Tb1, Tc1, which determine the temperature (Thead) at the point immediately preceding the first scan, are detected. Next, the processing proceeds to step S303, and refers to the pulse width and drive voltage table. If the temperature of any one of the chips is not greater than the threshold value Tth, the processing proceeds to step S304 to determine the pulse width and the drive voltage of the drive pulse by referring to the table. A head control section 603 shown in FIG. 6A supplies a control signal, for generating the drive pulse, set by the drive pulse width and drive voltage setting section 602, to the driver of the printing head to drive the printing head.

In the case of performing printing with the same head structure and the same drive condition from 25° C. to 45° C., the refill characteristics at 25° C. allow the ink meniscus to vibrate and become a convex shape at the ejection orifice so as to be projected, during the printing operation. As a result, wetting of ink on the surface of the ejection orifice and a deflection of the ejection direction of ink occur so that the printed image may be degraded. According to the present embodiment, in comparison with the first and second embodiments, since the pulse width and the drive voltage are varied in many degrees (FIG. 19C), and changes in the refill frequency and the drive frequency can become small, the vibration of the meniscus during the printing operation can be suppressed. In the present embodiment, at the condition of the drive voltage=12.4 V and the pulse width=0.8 $\mu$sec when the temperature is 45° C., the refill frequency is 25 kHz. This frequency can prevent the wetting of ink and the deflection of ink from occurring to keep the printed image to be of high quality. Though FIG. 19C does not show the value k, the relation between the drive voltage and the pulse width in the temperature range of the table is that which is determined under the condition of the value k being constant. Thereby, the energy applied to the printing head can be kept nearly constant.

As described in the foregoing, in the case of the jet-ink printer according to the embodiment of the present invention, the head temperature information outputted from the printing head is detected so that, when the head temperature has exceeded a predetermined temperature, the drive voltage and the drive pulse width can be altered to suppress the decrease of the refilling frequency while maintaining the input energy to the head at a constant level, and thus the deterioration of the image to be printed resulting from the decrease of the refilling characteristic due to the rise of the temperature and the decrease of the printing speed can be prevented.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing method using an ink ejecting head having a plurality of ejection orifices and a plurality of electro-thermal converting element for generating thermal energy for ejecting ink from the plurality of ejection orifices, respectively, to perform printing on a printing medium, said method comprising:

a setting step for obtaining a temperature of the ink ejecting head and changing settings of a pulse width and a drive voltage of a drive pulse to be applied to the electro-thermal converting elements; and a control step for controlling driving of the electro-thermal converting element with the drive pulse having the pulse width and the drive voltage, based on a result set by said setting step, wherein said setting step relatively shortens the pulse width and relatively raises the drive voltage as the temperature of the ink ejecting head relatively rises.

2. An ink jet printing method as claimed in claim 1, wherein said setting step includes a determining step for making a determination by comparing the temperature of the ink ejecting head with a predetermined temperature, and when said determining step makes a determination that the temperature of the ink ejecting head has exceeded the predetermined temperature, said setting step shortens the drive pulse width and raises the drive voltage.

3. An ink jet printing method as claimed in claim 2, wherein the predetermined temperature is in a temperature range at which a refill frequency for the ink ejecting head becomes lower than a drive frequency of the ink ejecting head.

4. An ink jet printing method as claimed in claim 1, wherein said control step outputs a plurality of pulses as the drive pulse for one ejection operation.

5. An ink jet printing method as claimed in claim 1, wherein an amount of energy applied to each of the electro-thermal converting elements is kept nearly constant regardless of the temperature of the ink ejecting head.

6. An ink jet printing method as claimed in claim 1, wherein, when the ink ejecting head is operated to perform the printing on the printing medium, said setting step alters the pulse width and the drive voltage before the performing of the printing is begun.

7. An ink jet printing method as claimed in claim 1, wherein said setting step alters the pulse width and the drive voltage each time the ink ejecting head scans in a scanning direction.

8. An ink jet printing method as claimed in claim 1, wherein each of the electro-thermal converting element includes a heating resistance layer and a protective layer, which is 2000–4000 Å thick and is formed from SiN, covering the heating resistance layer.

9. An ink jet printing method as claimed in claim 8, wherein each of the electro-thermal converting elements further includes a cavitation-proof layer on the protective layer, whereby a total thickness of layers covering the heating resistance layer becomes 4000–6600 Å.

10. An ink jet printing method as claimed in claim 9, wherein the cavitation-proof layer includes a Ta layer.

11. An ink jet printing apparatus using an ink ejecting head having a plurality of ejection orifices and a plurality of electro-thermal converting elements for generating thermal energy for ejecting ink from the plurality of ejection orifices, respectively, to perform printing on a printing medium, said apparatus comprising:

setting means for obtaining a temperature of the ink ejecting head and changing settings of a pulse width and a drive voltage of a drive pulse to be applied to the electro-thermal converting elements; and control means for controlling driving of the electro-thermal converting elements with the drive pulse having the pulse width and the drive voltage, based on a result set by said setting means, wherein said setting means relatively shortens the pulse width and relatively raises the drive voltage as the temperature of the ink ejecting head relatively rises.

12. An ink jet printing apparatus as claimed in claim 11, wherein said setting means includes a determining means for making a determination by comparing the temperature of the ink ejecting head with a predetermined temperature, and when said determining means makes a determination that the temperature of the ink ejecting head has exceeded the predetermined temperature, said setting means shortens the pulse width and raises the drive voltage.

13. An ink jet printing apparatus as claimed in claim 12, wherein the predetermined temperature is in a temperature range at which a refill frequency of the ink ejecting head becomes lower than a drive frequency of the ink ejecting head.

14. An ink jet printing apparatus as claimed in claim 11, wherein said control means outputs a plurality of pulses as the drive pulse for one ejection operation.

15. An ink jet printing apparatus as claimed in claim 11, wherein an amount of energy applied to each of the electro-thermal converting elements is kept nearly constant regardless of the temperature of the ink ejecting head.

16. An ink jet printing apparatus as claimed in claim 11, wherein each of the electro-thermal converting element includes a heating resistance layer and a protective layer, which is 2000–4000 Å thick and is formed from SiN, covering the heating resistance layer.

17. An ink jet printing apparatus as claimed in claim 16, wherein each of the electro-thermal converting elements further includes a cavitation-proof layer on the protective layer, whereby a total thickness of layers covering the heating resistance layer becomes 4000–6600 Å.

18. An ink jet printing apparatus as claimed in claim 17, wherein the cavitation-proof layer includes a Ta layer.

* * * * *